US007341217B2

(12) United States Patent
Cree

(10) Patent No.: US 7,341,217 B2
(45) Date of Patent: Mar. 11, 2008

(54) ELECTROSTATIC TENSION CONTROL OF WEBS

(75) Inventor: Robert E. Cree, Newark, NY (US)

(73) Assignee: Addex, Inc., Newark, NY (US)

( * ) Notice: Subject to any disclaimer, the term of this patent is extended or adjusted under 35 U.S.C. 154(b) by 0 days.

(21) Appl. No.: 11/060,074

(22) Filed: Feb. 17, 2005

(65) Prior Publication Data

US 2006/0180697 A1 Aug. 17, 2006

(51) Int. Cl.
*B65H 19/28* (2006.01)

(52) U.S. Cl. ..... 242/532

(58) Field of Classification Search ..... 242/416, 242/419, 420, 420.5, 527, 527.1, 527.2, 532.3, 242/532, 532.2, 421.4; 226/42, 94
See application file for complete search history.

(56) References Cited

U.S. PATENT DOCUMENTS 3,065,675 A * 11/1962 Vergobbi ..... 493/372
4,056,918 A 11/1977 Matsumoto
4,852,820 A 8/1989 Looser
5,226,611 A 7/1993 Butterworth
5,273,222 A 12/1993 Hutzenlaub et al.
5,275,348 A 1/1994 Looser
5,605,607 A * 2/1997 LaRose et al. ..... 204/164
5,713,534 A 2/1998 McClenathan
5,823,461 A 10/1998 Hartley et al.
5,848,761 A 12/1998 Reinhold
5,900,218 A 5/1999 LaRose et al.
6,499,639 B2 * 12/2002 Cote et al. ..... 226/42
2002/0063541 A1 5/2002 Cote et al.

FOREIGN PATENT DOCUMENTS

EP 0270498 A1 6/1988
GB 967174 8/1964

* cited by examiner

*Primary Examiner*—Peter M. Cuomo
*Assistant Examiner*—William E Dondero
(74) *Attorney, Agent, or Firm*—Wilmer Cutler Pickering Hale and Dorr LLP

(57) ABSTRACT

An electrostatic charging system holds a film web to a roll without significant slippage, thus allowing for proper tension control of the web even with extreme differences in tension upstream and downstream of the motorized roll. The system can electrostatically transfer a web using motorized drum rolls with an internally integrated web severing knife.

33 Claims, 3 Drawing Sheets

ELECTROSTATIC TENSION CONTROL OF WEBS

BACKGROUND

The present inventions relate to improving the quality of products produced by plastic resin extrusion lines.

When film is extruded, it typically is in the form of a flat continuous web as in cast film extrusion or a tubular form as in blown film extrusion. In blown film, the inflated tubular, bubble-type form passes through stabilizers of various designs and into a flattening device. This device, known as a collapsing frame, flattens the tube into a two sided, connected film with no air inside. In a flat state, webs are conveyed by various combinations of non-motorized and motorized rollers to a winder or to in-line downstream conversion, equipment such as printing presses, laminators, or bag machines. In a winder, a web may be cut into individual webs before the winding process, and the resulting rolls are converted at a later time in what is commonly termed an out-of-line converting process.

As film webs are conveyed to a winder or in-line conversion equipment, motorized rollers can be used at various points to maintain control of web tension. Except for the initial motorized roll immediately downstream of the extrusion process (commonly called the primary nip roll) where constant motorized roll speed is maintained without feedback, tension is typically measured in some way and provided as feedback to a motor controller. This motor controller is programmed to respond to maintain tension at a constant preset setting.

Typically, tension is measured either statically by measuring the applied force due to tension on load cell devices attached to idler rolls, or somewhat dynamically through what is commonly referred to as a dancer. A dancer is a series of idler rolls that move against springs, counterweights, air cylinders, or other such force applying devices in such a way as to allow the film's path length to change in response to tension variations and thus provide indication of film tension. In other cases, tension is measured indirectly by measuring the torque applied by the motorized roll and comparing the measurement to a no-load torque pre-measured in the absence of the web, taking into consideration roll geometry, and converting this to applied web tension.

An issue with maintaining proper tension control is web slippage when passing over motorized rolls. In many cases, additional rolls are pressed against the motorized roll to form a nip point that the web passes. The nip point acts to help hold the film against the motorized roll to prevent slippage. In other cases, large wrap angles around the motorized roll or more than one roll are used to provide a large enough surface area for friction to act and prevent slippage. Combinations of nipping and large wrap angle may not always prevent slippage and thus can lead to tension control problems as the web becomes uncontrollable.

One such area is the motorized roll used in the winding process known commonly as the lay-on or winding drum. The winding drum is the final motorized roll the web passes over before being wound on the finished roll. Good tension control should be maintained by the winding drum or undesirable defects in the roll can result. In some winding machines, the finished roll shaft is also motorized to aid in maintaining proper tension control of the web as the finished roll builds in diameter to a final roll diameter over time such as disclosed in U.S. Pat. No. 5,275,348.

In practice it is desirable to maintain constant tension before reaching the winder drum for such purposes as slitting the web into multiple webs, slitting trim from the edges or middle for maintaining high quality roll ends, and minimizing wrinkling and deformation of the web before winding on the finished roll. It is further desirable to control the tension on the finished roll to tensions that are different from upstream tension especially when making very large rolls. Excessive winding tension can create roll quality issues or even crush the central winding core. However, higher tensions are beneficial to the upstream cutting and trimming processes.

A limitation of some devices, such as the winding devices described in U.S. Pat. No. 5,275,348, is that they require essentially zero winding drum for proper tension control to be achieved. In practice, devices such as these exhibit slippage when significant differences exist in tension upstream and downstream of the motorized drum roll and thus limit the tension difference achievable. In practice, depending on web and drum materials used, small differences of as little as 0.1 or 0.2 pounds per linear inch of web width across the face of the motorized roll are enough to cause slippage of the web. Typical web tensions within these extrusion processes range from 0.25 to 2.0 pounds per linear inch.

A situation for maximum tension differential exists when winders, which are required to continuously handle a web without interruption, are transitioning from winding one roll to the next. Extrusion processes are run continuously, so the web is severed at the conclusion of building a finished roll to final diameter and the loose incoming end is taken up onto a new winding core to start building a new roll without stopping or slowing the upstream process. The severing process causes tension in the web local to the severing device to suddenly drop to zero, creating instantaneous slippage on the motorized drum roll since now tension differences are maximized.

U.S. Pat. No. 5,848,761 shows one example of a device in which a severing knife is contained within a motorized winding drum. This arrangement makes the slippage problem especially troublesome. In this case, a vacuum chamber within the drum roll is energized to hold the web in place and prevent slippage until a new winding core acquires a loose incoming cut edge of the web and reestablishes web tension. In practice, some slippage does still occur and the complexity of such systems is very costly.

Prior methods exist for acquiring a loose incoming cut edge of a web. Sticky substances such as glue or tape are popular but messy and typically create undesirable impressions in the wound web. Other techniques as shown in U.S. Pat. No. 4,852,820 employ an electrostatic charging device between a motorized winding drum and a finished roll that is about to be cut free. This eliminates the problems associated with using glue or tape. The incoming winding core is held generally opposite the electrostatic charging device after the motorized winding drum with the web passing in between. Just before severing the web, an electrostatic charge is applied to the web opposite the incoming winding core. This causes an electrostatic force that acts to push the web toward the incoming winding core. This force of attraction is due to electrostatically formed ions preferably placed on the opposite side of the web. These ions are drawn to the ground potential of the incoming conductive and grounded winding shaft which holds the incoming typically not conductive, winding core. These ions act to carry the web with them and try to attach the web to the winding core. The web is then severed nearby the charging device and the completed finished roll. The loose incoming web end is electrostatically attracted to the incoming winding shaft where it attaches to the new core and begins to build a new roll.

One drawback of motorized drum rolls as shown in U.S. Pat. No. 5,848,761 containing the severing knife within itself is that the elect positioned between the severing knife and the motorized winding drum because these latter two are formed in one unit. This makes it impossible to use the electrostatic transfer method described in U.S. Pat. No. 4,852,820.

SUMMARY

The systems described here relate to electrostatic charging systems that hold a film web to a motorized roll. This is done without significant slippage, thus allowing for proper tension control of the web even with extreme differences in tension upstream and downstream of the motorized roll. In one embodiment, a wrap angle of at least approximately 10 degrees is used to provide a surface area in contact with the motorized roll over which electrostatic forces act to hold the web without slippage. A nip roll is not required, but if present, should not be placed in such a way that the electrostatic charge is bled off the web prematurely, although in most cases it is desirable to remove excess electrostatic charge before reaching the finished roll since this can cause significant undesirable problems in finished rolls. Removal of undesirable electrostatic charge can be accomplished in many ways, such as by direct contact of intervening conductive rolls or by well known non-contacting electrostatic elimination devices, but at a location that does not significantly affect tension controlling properties of the device.

These systems can avoid a need for complex vacuum holding systems and nip rolls, especially as it pertains to winding with motorized drum rolls with integral web severing knives. The systems can also provide improved tension control without unwanted electrostatic buildup within finished rolls because there is no web slippage even under extremes of differential tension present on opposite sides of motorized rolls within an extrusion process such as those that occur during web transfer or within machines that highly stretch the web. An additional feature of these systems is that they can provide a torque boost to the motor of a motorized drum roll equivalent to a downstream tension force effect on the web upon severing of that web on or nearby the motorized drum roll to substantially maintain a constant upstream web tension whether electrostatically or otherwise maintained.

The motorized roll itself can be electrically charged or un-grounded to neutralize its attractive effect on electrostatic charges present, especially those on the opposite side of the web, which produce attractive forces that carry the web and hold it to the motorized roll. This neutralizing effect can be virtually instantaneous.

One possible benefit is allowing for electrostatically transferring a web using motorized drum rolls with an internally integrated web severing knife. In this case, a non-conductive coating, such as polyurethane or any other such suitable substance is applied to the motorized drum roll containing an internal severing knife to form a motorized transfer drum. A static charge is optionally applied between the surface of the motorized transfer drum and the web, then also to the surface of the web opposite the motorized transfer drum such that electrostatic charge is present on both sides of the web. In this case, both layers of electrostatic charges will be attracted to the motorized transfer roll as long as it is at ground potential and the web will be attached to the motorized transfer drum by the charges located opposite the drum. A grounded conductive shaft holding an incoming winding core is subsequently brought substantially parallel and in close proximity which acts to attract the web due to charges on the opposite side of the web which act to substantially cancel the attractive force of the still grounded motorized transfer drum. The web is then severed and more or less simultaneously, the motorized transfer drum is electrically charged to the same polarity of the charged ions adjacent the web or un-grounded to neutralize its effect on the ions and thus on the web. This allows the web to be drawn toward the incoming grounded shaft and attach to the winding core as subsequent electrostatic transfer occurs.

While certain benefits are described, a given system need not have all of these benefits.

Other features and advantages will become apparent from the following detailed description, drawings, and claims.

DETAILED DESCRIPTION

Figure 1:
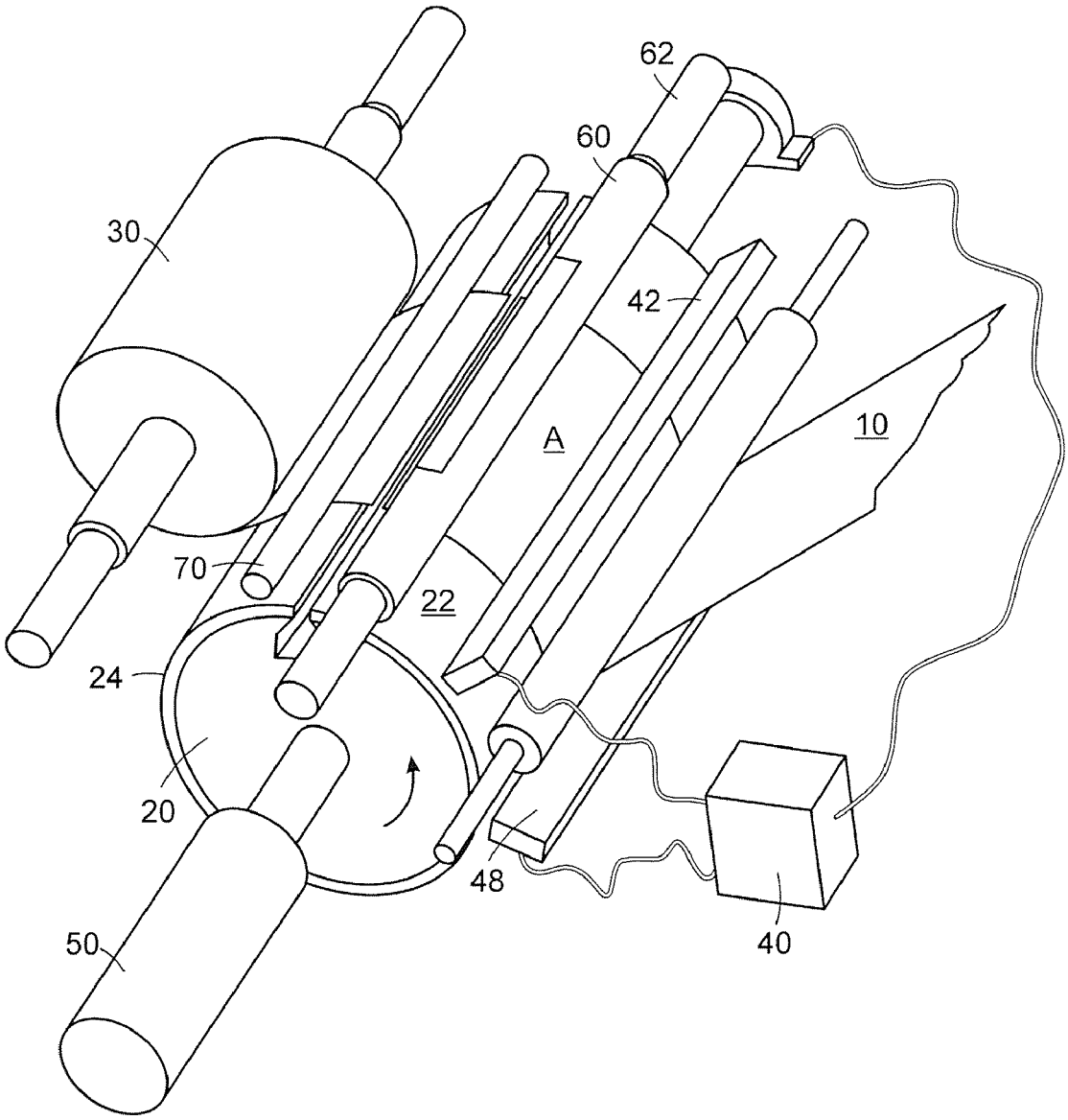
FIG. 1 is an isometric view of an electrostatic web transfer device for transferring a web in a winding process employing a motorized drum roll containing an integrated severing knife.
Figure 2:
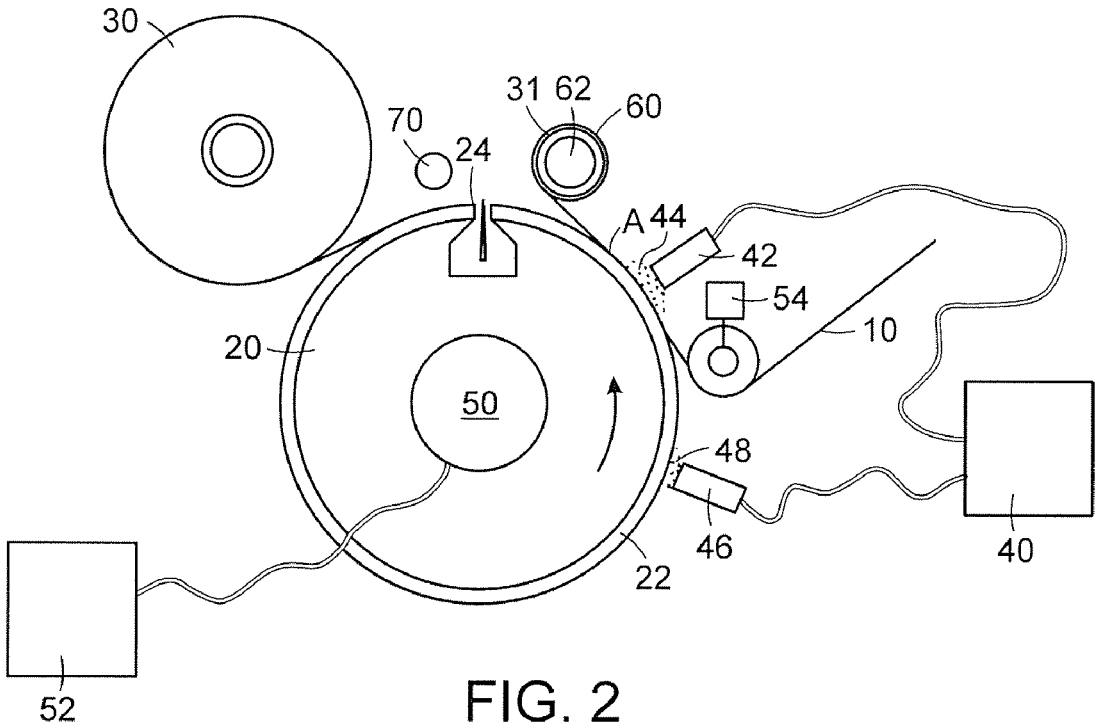
FIG. 2 is a schematic side view of an electrostatic web transfer device for transferring a web in a winding process employing a motorized drum roll containing an integrated severing knife.
Figure 3:
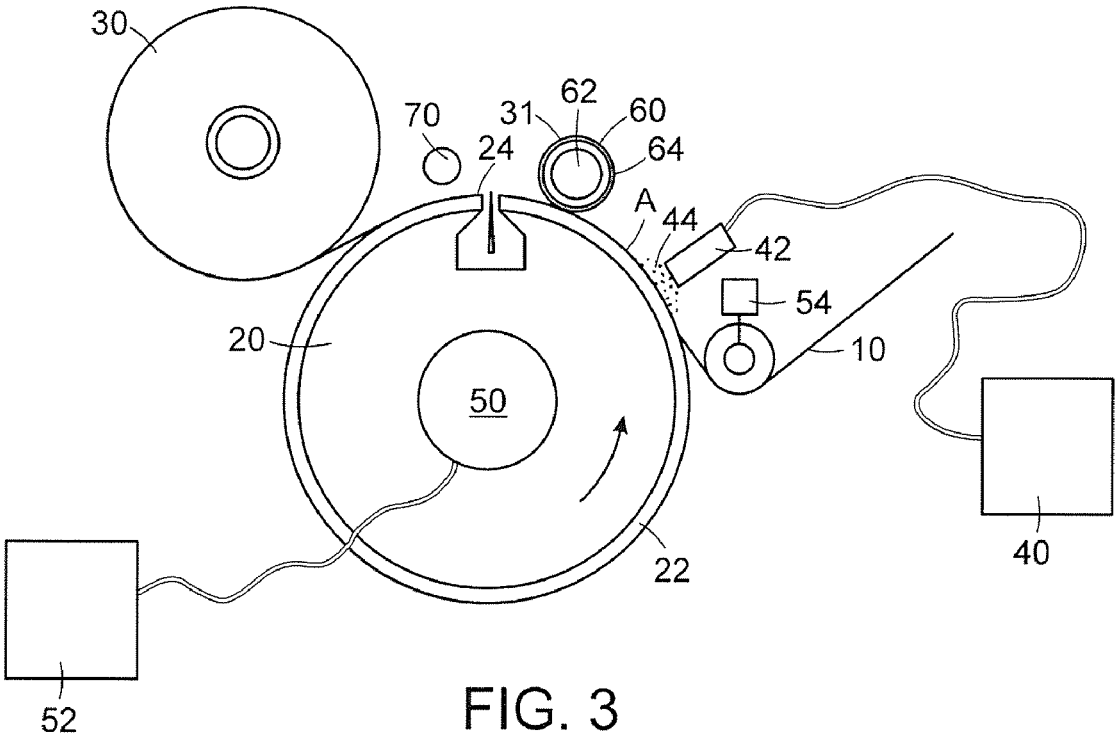
FIG. 3 is a schematic side view of an electrostatic web holding system used for motorized drum rolls containing an integrated severing knife to transfer webs using non-electrostatic attraction to incoming cores and shafts.

FIGS. 1-3 illustrate a web transfer device that can replace a known vacuum based web transfer system for winding continuous webs. A web 10 is conveyed onto a motorized drum, in this embodiment a transfer drum (conveying roll) 20, which is substantially earth grounded, for subsequent winding onto a finished roll 30. Finished roll 30 can be in contact, or free from contact, with transfer drum 20. Drum 20 is motorized and as shown is driven counter-clockwise by motor 50, but can also turn clockwise with web 10 passing in the opposite direction around transfer drum 20 to cause web 10 to wind on finished roll 30 with the opposite side of web 10 to the outside of finished roll 30.

Referring particularly to FIG. 2, a charging device 40 energizes an electrostatic bar 42, which generates ions 44 that are attracted to earth ground presently found on transfer drum 20. Web 10 is pressed against transfer drum 20 due to electrostatically attractive forces between ions 44 and presently grounded transfer drum 20, thus preventing significant slippage of web 10 on transfer drum 20. The electrostatic bar can be operated while the web is being conveyed over the drum, and can be used while the web is being wound, and not just to move a web during transfer of the web to another drum. The electrostatic bar provides tension without a nip roll and without an S-wrap series of rollers (although in some embodiments these parts could be used also). The ions can be provided continuously, rather than just during a process of transferring a web from a finish roll to a new core, and can be provided substantially all the time, i.e., during normal operation.

Motor 50, controlled by motor drive 52, is responsive to signals from upstream web tension sensor 54 measured by any of several typically known means to maintain the upstream web tension at desired levels. Advantageously, drive 52 may apply a calculated torque dependent on desired web tension, a known radius of transfer drum 20, and pre-measured frictional losses, through motor 50 to transfer drum 20 to maintain the desired tension in web 10 without resorting to direct measurement of web tension. Motor drives, such as model ACS-600 or 800 from ABB Corporation, are based on technology know as direct torque control which can be used to facilitate the torque measuring and control functions.

An optional electrostatic neutralizer 70, which can be any suitable device such as a conductive roll or (if there is a lack of physical space) an electrostatic eliminator bar may be used for removing charged ions from the surface of web 10 and transfer drum 20. If used, electrostatic neutralizer 70 is positioned to allow for sufficient wrap angle of at least 10° around transfer drum 20 to allow for positive tension control before neutralization of ions 44. It is desirable to neutralize ions 44 before being wound on finished roll 30 because excessive charge can cause the web to have undesirable clinging effects to other surfaces and can cause sudden electrostatic discharge to other nearby objects or to personnel working in the area. Electrostatic neutralizer 70, if present, may be advantageously turned off just before transferring web 10 at the completion of winding finished roll 30 so as not to interfere with the transfer process.

Referring only to FIGS. 1 and 2, grounded transfer drum 20 is coated with substantially non-conductive covering 22 to prevent dissipation of any applied electrostatic charges. Just before completion of winding finished roll 30, an incoming core 60 is brought adjacent to grounded transfer drum 20 by incoming winding shaft 62, which is grounded to prepare for the transfer of web 10. A second electrostatic bar 46 energizes to generate ions 48. Ions 48 are positioned between web 10 and the surface of transfer drum 20. Ions 44 and 48 are attracted to grounded transfer drum 20 and to grounded incoming winding shaft 62 which carries incoming core 60 but are not dissipated due to the presence of non-conductive covering 22 and incoming core 60. Severing knife 24 within drum 20 cuts web 10. Transfer drum 20 is then purposefully ungrounded to release the attractive forces on ions 44 and 48 which sandwich web 10 between at point A. Optionally, charging device 40 may energize transfer drum 20 to enhance the release of attractive forces on ions 44 and 48 which sandwich web 10 such as at point A to enhance the forces which act to attach web 10 to core 60 due to attractive forces felt between ions 44 and 48 and still grounded incoming winding shaft 62.

More or less simultaneously, and when the trailing end of now severed web 10 begins to slip off transfer drum 20 onto finished roll 30 and until firm attachment of web 10 to incoming core 60, a boost in torque equivalent to the calculated loss in downstream tension due to severing of web 10 leading to finished roll 30 optionally may be applied to transfer drum 20 by motor 50 and motor drive 52 to maintain substantially uniform tension 54 upstream of transfer drum 20 during web 10 transfer. This torque boost is generally not required in applications where finished roll 30 is not also powered by a suitable motor to apply tension on its own accord to web 10 as such process is well known in the industry. Incoming grounded winding shaft 62 continues to apply attractive forces to ions 44 and 48. Ions 44 tend to directly attach to incoming core 60, whereas ions 48 carry with them and attach web 10 to incoming core 60 where web 10 begins to wind as new finished roll 31. Electrostatic bar 46 is then turned off in preparation for the next transfer cycle. Electrostatic bar 42 may also be turned off if not required to maintain positive tension control over web 10. Electrostatic neutralizer 70, if present, can be turned on until the next transfer cycle occurs. The now complete finished roll 30 is removed and the process is allowed to repeat itself continuously. Any applied torque boost to transfer drum 20 is removed upon proper tensioning of new finished roll 31.

Referring to the embodiment of FIG. 3, a tacky substance 64 such as glue, tape or any other substance suitable for adhering web 10 to incoming core 60 can be pre-applied to incoming core 60. Just before completion of winding finished roll 30, incoming core 60 with tacky substance 64 is brought adjacent to transfer drum 20 by incoming winding shaft 62 in preparation for the transfer of web 10. Ions 44 continue to press web 10 against transfer drum 20 due to electrostatically attractive forces between ions 44 and presently grounded transfer drum 20. Covering 22 can either be conductive or non-conductive since ions 44 adjacent to web 10 are insulated from conductive transfer drum 20 by web 10 to prevent dissipation of any applied electrostatic charges in the area of web 10. Severing knife 24 acts to cut web 10. More or less simultaneously, and when the trailing end of now severed web 10 begins to slip off transfer drum 20 onto finished roll 30, and until firm attachment of web 10 to incoming core 60, a boost in torque equivalent to the calculated loss in downstream tension due to severing of web 10 leading to finished roll 30 optionally may be applied to transfer drum 20 by motor 50 and motor drive 52 to maintain substantially uniform tension 54 upstream of transfer drum 20 during web 10 transfer. This torque boost is generally not required in applications where finished roll 30 is not also powered by a suitable motor to apply tension on its own accord to web 10 as such process is well known in the industry.

Incoming winding shaft 62 moves incoming core 60 with tacky substance 64 into contact with web 10 which until contact with tacky substance 64 remains attached to still grounded transfer drum 20 due to electrostatically attractive forces between ions 44 and presently grounded transfer drum 20. Web 10 is forcibly attached onto incoming core 60 by tacky substance 64 which overcomes the electrostatically attractive forces between ions 44 and presently grounded transfer drum 20 and causes web 10 to begin to wind as a new finished roll 31. The now complete finished roll 30 is removed and the process is allowed to repeat itself continuously.

Referring again to FIGS. 1-3, after transfer when web 10 is attached to incoming core 60, electrostatic bar 42 can optionally be de-energized if it is not required to prevent slippage and maintain proper tension control of web 10 as it passes over transfer drum 20. In these cases optional electrostatic neutralizer 70 may not be needed since electrostatic ions are only applied to web 10 during transfer which occurs typically over a very small time frame compared to the time required to wind up a complete finished roll 30.

Figure 4:
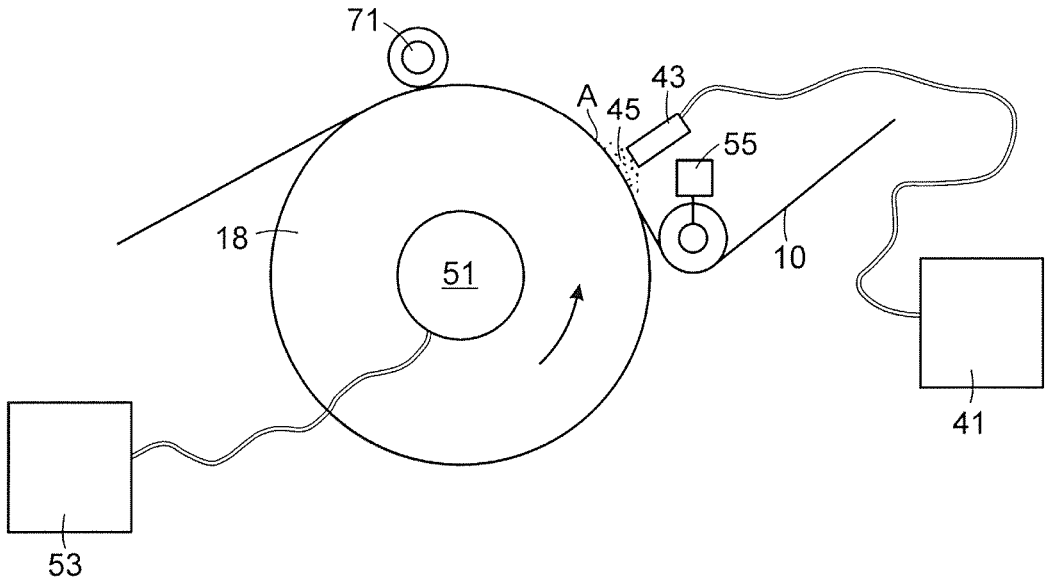
FIG. 4 is a schematic side view of an electrostatic, tension controlling, motorized roll showing an optional electrostatic elimination process.

Referring now to FIG. 4, web 10 is conveyed onto roller 18 which is conductive and substantially earth grounded. Charging device 41 energizes electrostatic bar 43 which generates ions 45 that are attracted to earth ground of roller 18. Web 10 is pressed against grounded roller 18 due to electrostatically attractive forces between ions 45 and roller 18, thus preventing significant slippage of web 10 on roller 18. Motor 51, controlled by motor drive 53, is responsive to upstream web tension sensor 55 that measures tension to maintain the upstream web tension at desired levels. The web conveying system shown in FIG. 4 can be used as part of a transfer system to a finish roll for winding the web, or can be used to convey a web to other equipment.

Advantageously and optionally, torque equivalent to the calculated desired difference in upstream and downstream tension plus pre-measured torque required to just overcome frictional losses may be applied to roller 18 by motor 51 and motor drive 53 to maintain substantially uniform tension both upstream and downstream of roller 18.

Optional electrostatic neutralizer 71, which can be any suitable device such as an electrostatic eliminator bar, or due to their common use in areas other than between winding transfer drums such as transfer drum 20 of FIGS. 1, 2, and 3, preferably a conductive roll, may be used for removing charged ions from the surface of web 10. If used, electrostatic neutralizer 71 is positioned downstream to allow for sufficient wrap angle of at least 10 degrees around roller 10 to allow for positive tension control before ion 45 neutralization.

While certain structural embodiments have been described, it should be understood that various modifications can be made to the above-described embodiments without departing from the spirit and scope of the invention as defined in the appended claims. For example, further rolls (passive or motorized) and other equipment for sensing and/or conveying can be provided before or after the web is conveyed by roller 18 or drum 20.

What is claimed is:

1. A web conveying device comprising:

a conveying roll for conveying a web of film;

a first ion generator for generating a first set of ions attracted to the roll for holding the web to the conveying roll;

a severing knife within the roll for cutting the web;

an incoming core for being brought adjacent to the conveying roll before completion of a finished roll;

wherein the conveying roll is coated with substantially non-conductive covering to prevent dissipation of applied electrostatic charges; and a second ion generator spaced from the first ion generator for generating a second set of ions attracted to the conveying roll to position the second set of ions between the conveying roll and the web.

2. The device of claim 1, further comprising a web tension sensor and a motor drive responsive to signals from the sensor for controlling the motor in response thereto.

3. The device of claim 1, further comprising a motor drive for driving the conveying roll, wherein the motor drive applies a calculated torque dependent on a desired web tension upstream and downstream from the motorized roll and on frictional losses.

4. The device of claim 3, wherein the motor drive uses direct torque control.

5. The device of claim 1, further comprising an electrostatic neutralizer for removing charged ions from a surface of the web and from the conveying roll.

6. The device of claim 5, wherein the electrostatic neutralizer is one of a conductive roll and an electrostatic eliminator.

7. The device of claim 1, wherein the web has a wrap angle of at least about 10° around the conveying roll.

8. The device of claim 1, wherein the conveying roll is motorized.

9. A web conveying device comprising:

a conveying roll for conveying a web of film, where the conveying roll is conductive and has a substantially non-conductive covering;

a first ion generator for generating ions attracted o the conveying roll for holding the web to the conveying roll;

a finished roll for receiving the web from the conveying roll;

a core moveable to a position adjacent the conveying roll for transfer to the core; and a second ion generator for generating ions attracted to the conveying roll and spaced from the first ion generator for providing ions between the conveying roll and the web.

10. The device of claim 9, wherein the conveying roll is motorized.

11. A method comprising:

receiving a web of film on a conveying roll;

generating a first set of ions to attract the web to the conveying roll for holding the web to the conveying roll;

cutting the web with a severing knife;

conveying the web to further equipment including providing the web to a finished roll;

bringing an incoming core adjacent to the conveying roll before completion of the roll on the finished roll;

wherein the conveying roll has a substantially non-conductive covering, the method further comprising generating a second set of ions for attraction to the conveying roll and positioning the second set of ions between the conveying roll and the web to help separate the web from the conveying roll.

12. The method of claim 11, further comprising operating the conveying roll with a motor, sensing an upstream web tension, and providing signals to a motor drive for controlling the motor in response to the signals.

13. The method of claim 11, further comprising operating the conveying roll with a motor, wherein the motor drive applies a calculated torque dependent on a desired web tension upstream and downstream from the motorized conveying roll and on frictional losses.

14. The method of claim 13, wherein the motor drive uses direct torque control.

15. The method of claim 11, further comprising using an electrostatic neutralizer for remove removing charged ions from a surface of the web and from the conveying roll.

16. The method of claim 11, further comprising positioning the web and conveying roll so that the web has a wrap angle of at least about 10° around the conveying roll.

17. The method of claim 11, wherein conveying the web to further equipment includes providing the web to a finished roll.

18. The method of claim 17, further comprising bringing an incoming core adjacent to the conveying roll before completion of the roll on the finished roll.

19. The method of claim 18, further comprising applying a tacky substance to the incoming core for adhering the web to the incoming core.

20. A method comprising:

receiving a web of film on a conveying roll;

generating ions to attract the web to the conveying roll for holding the web to the conveying roll;

conveying the web to further equipment; and ungrounding the conveying roll to release the attractive forces on ions that draw the web to the conveying roll.

21. The method of claim 20, wherein the process of generating ions is performed substantially all the time to assist with holding the web to the conveying roll.

22. A method comprising:

receiving a web of film on a conveying roll;

generating ions to attract the web to the conveying roll for holding the web to the conveying roll;

conveying the web to further equipment; and energizing the conveying roll to enhance the release of attractive forces on ions that draw the web to the conveying roll.

23. The method of claim 22, wherein the process of generating ions is performed substantially all the time to assist with holding the web to the conveying roll.

24. A web conveying device comprising:

a conveying roll for conveying a web of film, where the conveying roll is conductive and has a substantially non-conductive covering;

a first ion generator for generating ions attracted to the conveying roll for holding the web to the conveying roll;

a second roll movable to a position adjacent the conveying roll before completion of the finished roll; and a second ion generator spaced from the first ion generator for generating ions attracted to the conveying roll to position ions from the second ion generator between the conveying roll and the web.

25. The device of claim 24, wherein the conveying roll is motorized.

26. The device of claim 24, further comprising a severing knife within the conveying roll for cutting the web.

27. A web conveying device comprising:

a conveying roll for conveying a web of film along an arc, where the conveying roll is conductive and has a substantially non-conductive covering; and an ion generator for generating ions attracted to the conveying roll, where the ion generator is at a position outside the arc such that as the web is brought into contact with the conveying roll, the ions are between the conveying roll and the web.

28. The device of claim 27, wherein the conveying roll is motorized.

29. The device of claim 27, wherein the conveying roll is not an electrical ground.

30. A method comprising:

receiving a web of film on a conveying roll, wherein the conveying roll is conductive and has a substantially non-conductive covering;

generating a first set of ions to attract the web to the conveying roll for holding the web to the conveying roll;

conveying the web to further equipment including providing the web to a finished roll;

bringing an incoming core adjacent the conveying roll before completion of the roll on the finished roll;

severing the web;

generating a second set of ions for attraction to the conveying roll between the web and the covering;

causing the second set of ions to be attracted to the core; and cutting the web with a severing knife.

31. A method comprising:

receiving a web of film on a conveying roll, wherein the conveying roll is conductive with a substantially non-conductive covering;

generating ions for attraction to the conveying roll at a position such that the ions are between the conveying roll and the web; and conveying the web to further equipment including providing the web to a finished roll.

32. The method of claim 31, wherein the process of generating ions is performed substantially all the time to assist with holding the web to the conveying roll.

33. The method of claim 31, further comprising cutting the web with a severing knife and bringing a core to a position adjacent the conveying roll before completion of the roll on the finished roll.

* * * * *